US006116460A

United States Patent [19]

Kim et al.

[11] Patent Number: 6,116,460

[45] Date of Patent: Sep. 12, 2000

[54] VENDING MACHINE

[75] Inventors: Oh-Bok Kim; Bo-Hyun Jang, both of Kwangju, Rep. of Korea

[73] Assignee: Samsung Kwang-Ju Electronics Co., Ltd., Kwangju, Rep. of Korea

[21] Appl. No.: 09/099,322

[22] Filed: Jun. 18, 1998

[30] Foreign Application Priority Data

Jun. 18, 1997 [KR] Rep. of Korea ..... 97-25408
Aug. 30, 1997 [KR] Rep. of Korea ..... 97-24833

[51] Int. Cl.[7] ..... A47F 1/00

[52] U.S. Cl. ..... 221/96; 222/129.1

[58] Field of Search ..... 221/96, 92, 123; 222/144.5, 129.1, 129

[56] References Cited

U.S. PATENT DOCUMENTS 3,247,940 4/1966 Christine et al. ..... 221/96

FOREIGN PATENT DOCUMENTS 8-69569 3/1996 Japan .

*Primary Examiner*—Kenneth W. Noland
*Attorney, Agent, or Firm*—Burns, Doane, Swecker & Mathis, L.L.P.

[57] ABSTRACT

Disclosed is a vending machine including a body defining an exterior of the vending machine, a plurality of mixture containers holding various powdered mixtures, a cup dispenser containing a plurality of cups and which dispenses the same, and a cup tray for receiving cups and from which the customer withdraws the same after the beverage has been made. The vending machine further includes a cup transfer device provided between the cup dispenser and the cup tray, the cup transfer device receiving a cup from the cup dispenser, moving the cup under supply pipes of the mixture containers, and after the cup has received a predetermined amount of a powdered mixture from the same, dropping the cup on the cup tray.

15 Claims, 8 Drawing Sheets

VENDING MACHINE

BACKGROUND OF THE INVENTION

1. Field of the Invention

The present invention relates to a vending machine, and more particularly, to a vending machine in which powdered mixtures and water are directly dispensed into a cup without the use of a conventional mixer such that beverages are provided in a clean and sanitary manner.

2. Description of the Prior Art

Vending machines are used to sell a variety of products such as coffee and tea placed in cups, cigarettes, canned beverages, etc. They are generally coin-operated with some accepting paper bills, and have the advantage of being able to be placed in most any location without requiring the constant presence of an employee to sell products. FIG. 1 is a view illustrating an interior of the prior art cup beverage vending machine.

As shown in the drawing, the conventional cup beverage vending machine comprises a body 10 defining the exterior of the vending machine; a plurality of mixture containers 11, each holding a different powdered mixture of coffee, tea, etc.; at least one water tank 12 containing water; and a cup dispenser 13 holding a plurality of cups (not shown). Also, disposed under the water tank 12 for heating the water provided from the same to a high temperature is a hot water tank 14, and disposed under the mixture containers 11 for mixing the powdered mixtures supplied from the same with the hot water is a mixer 15.

In the conventional vending machine structured as in the above, when a signal is input by a selection made by a customer, a powdered mixture of a beverage corresponding to the signal and hot water are supplied respectively from the mixture containers 11 and the hot water tank 14 to the mixer 15. After the mixture is combined with the hot water in the mixer 15, the resulting beverage is supplied through a beverage supply line 16 to a cup positioned in a cup holding portion 17. The customer then removes the cup from the cup holding portion 17 to consume the beverage.

However, in such a conventional cup vending machine, the powdered mixtures often become at least partly solidified by humidity especially in high temperature and high humidity conditions. As a result, the powdered mixtures adhere to outlets of the mixture containers and pipes supplying the powdered mixtures to the mixer such that full or partial blockage occurs.

The above problem leads also to unsanitary conditions. That is, with the passage of time, the powdered mixtures stuck to various internal areas of the vending machine become spoiled such that, without the frequent cleaning of these areas, beverages made become contaminated.

Further, because a mixer, a water supply line and a beverage supply line must be installed for each variety of beverage, the structure of the vending machine becomes complicated.

SUMMARY OF THE INVENTION

The present invention has been made in an effort to solve the above problems.

It is an object of the present invention to provide a vending machine in which powdered mixtures and water are directly dispensed into a cup to be mixed therein such that both 1) beverages are provided in a clean and sanitary manner, and 2) the structure of the vending machine is simplified.

To achieve the above object, the present invention provides a vending machine including a body defining an exterior of the vending machine, a plurality of mixture containers holding various powdered mixtures, a cup dispenser containing a plurality of cups and which dispenses the same, and a cup tray for receiving cups and from which the customer withdraws the same after the beverage has been made.

The inventive vending machine further includes a cup transfer device provided between the cup dispenser and the cup tray, the cup transfer device receiving a cup from the cup dispenser, moving the cup under supply pipes of the mixture containers, and after the cup has received a predetermined amount of a powdered mixture from the same, dropping the cup on the cup tray.

The cup transfer device includes cup supporting means for receiving and holding the cups discharged from the cup dispenser, a motor for rotating the cup supporting means, motor control means for controlling the drive operation of the motor, and cup dropping means for controlling the dropping of the cups from the cup supporting means onto the cup tray.

The cup supporting means comprises a fixing portion connected to a shaft of the motor, the fixing portion having an opened portion formed on one side thereof; a first holder integrally formed on an upper part of the fixing portion and having a predetermined curvature; a rotating portion positioned partly in the opened portion of the fixing portion and rotatably connected to the shaft of the motor; and a second holder integrally formed on an upper part of the rotating portion and having a predetermined curvature, the second holder opposing the first holder to form a partial hoop with the same such that one of the cups can be supported.

The first and second holders follow a rotational path of being positioned under a cup discharge portion of the cup dispenser in a stand-by state, when the motor is not operating; being positioned under the supply pipes of the mixture containers; being positioned above the cup tray, then back under the cup dispenser.

The supply pipes of the mixture containers are directed to a single area to form a semi-circle, and a cover is mounted to one side of the supply pipes to prevent the scattering of the powdered mixtures during the supply of the same into the interior of the vending machine.

The motor control means comprises a cam connected to the shaft of the motor and rotating together with the same, and first and second microswitches contacting an outer circumference of the cam.

The cam is cylindrical and has formed first and second grooves on an outer circumference thereof, the first groove being formed extending from a top of the cam to a bottom of the same, while the second groove being formed starting from the top of the cam but stopping at a middle portion thereof.

When the first and second holders are positioned under the cup discharge portion of the cup dispenser in the stand-by state of the vending machine, the first and second microswitches are positioned at the first groove to be in an OFF state; and when the first and second holders are positioned under the supply pipes of the mixture containers by the operation of the motor, the first microswitch is positioned at the second groove to be in an OFF state, while the second microswitch is positioned contacting the outer circumference of the cam to be in an ON state such the motor is stopped from a predetermined amount of time to enable a predetermined amount of a powdered mixture from one of the mixture containers to be dispensed in a cup.

A connecting portion is integrally formed to a top of the cam extending upwardly from the same, the connecting portion passing through the duct; and a spring is interposed between the connecting portion and the rotating portion to provide elasticity to the second holder.

The cup dropping means comprises a catch member connected to a bracket, the bracket provided between the cup dispenser 53 and the duct to support the same; and an extension formed on the second holder and protruding upward from a rear portion of the same.

The catch member comprises a support connected to one side of the bracket, and an elongating piece rotatably connected to a bottom of the catch member with an elastic member interposed therebetween. It is preferable that the elastic force of the elastic member of the catch member is greater than that of the spring supporting the second holder.

When the first and second holders are positioned over the cup tray, the second holder is prevented from further rotation by the extension formed thereon contacting with the elongating piece of the catch member such that the second holder is distanced from the first holder to enable the cup to drop onto the cup tray, after which the extension of the second holder passes over the catch member so that the second holder returns to its initial position having a predetermined distance from the first holder.

A powdered mixture collector is further provided as part of the cup transfer device, the powdered mixture collector gathering the powdered mixtures not fully extracted from the supply pipes of the mixture containers during the supply of the powdered mixtures to the cups. The powdered mixture collector is removably mounted on a back of the fixing portion, and is positioned under the supply pipes of the mixture containers when the vending machine is in a stand-by state.

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

Preferred embodiments of the present invention will now be described in detail with reference to the accompanying drawings.

Figure 1:
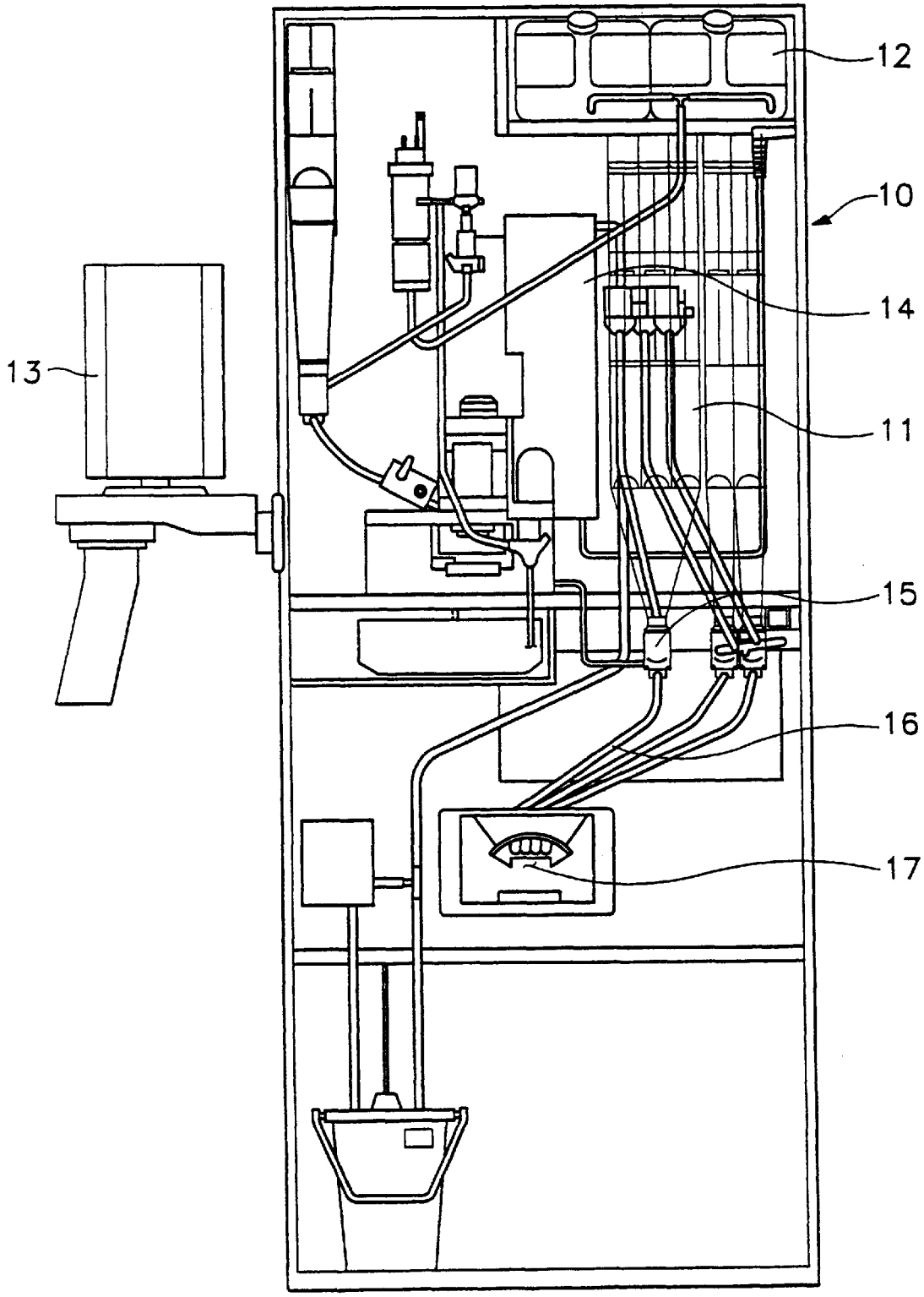
FIG. 1 (PRIOR ART)
FIG. 1 is a view illustrating an interior of the prior art vending machine.
Figure 2:
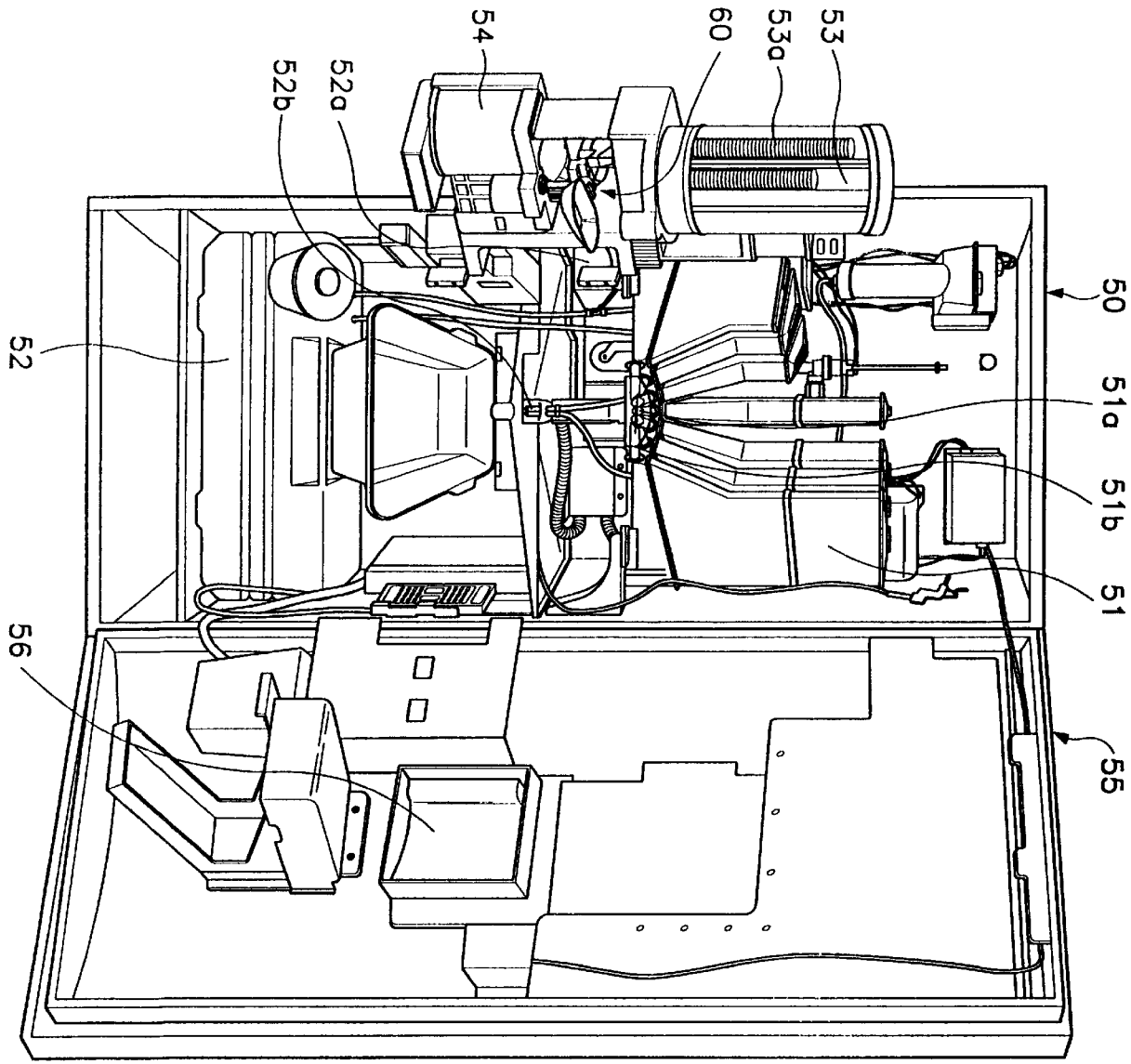
FIG. 2 is a view illustrating an interior of a vending machine according to a preferred embodiment of the present invention.

Referring first to FIG. 2, shown is a view illustrating an interior of a vending machine according to a preferred embodiment of the present invention.

As shown in the drawing, the inventive vending machine comprises a body 50 defining an exterior of the vending machine; a plurality of mixture containers 51 holding various powdered mixtures of coffee, tea, etc. and which discharge a predetermined amount of one of the mixtures for each selection made by a customer; a cup dispenser 53 containing a plurality of cups 53*a* and which dispenses the same one at a time; a cup tray 54 for receiving cups 53*a* and from which the customer withdraws the same after the beverage has been made; a water tank 52 containing water; and a hot water tank 52*a* for heating water received from the water tank 52 and supplying predetermined amounts of the water to a cup 53*a* via a nozzle 52*b*.

Further, a door 55 is hingedly provided on one side of the body 50, the door 55 swinging to open and close a front of the vending machine. An opening 56 is formed on the door 55 corresponding to a position of the cup tray 54 when the door 55 is closed such that the customer can access the cup tray 54.

Each of the mixture containers 51 has a supply pipe 51*a* which are directed to a single area to form a semi-circle. A cover 51*b* is mounted to one side of the supply pipes 51*a* to prevent the scattering of the powdered mixtures during the supply of the same into the interior of the vending machine.

As a main inventive concept of the present invention, a cup transfer device 60 is provided between the cup dispenser 53 and the cup tray 54. The cup transfer device 60 receives a cup 53*a* from the cup dispenser 53, moves the cup 53*a* under the supply pipes 51*a* of the mixture containers 51, and after the cup 53*a* has received a predetermined amount of a powdered mixture from the same, drops the cup 53*a* on the cup tray 54.

Figure 3:
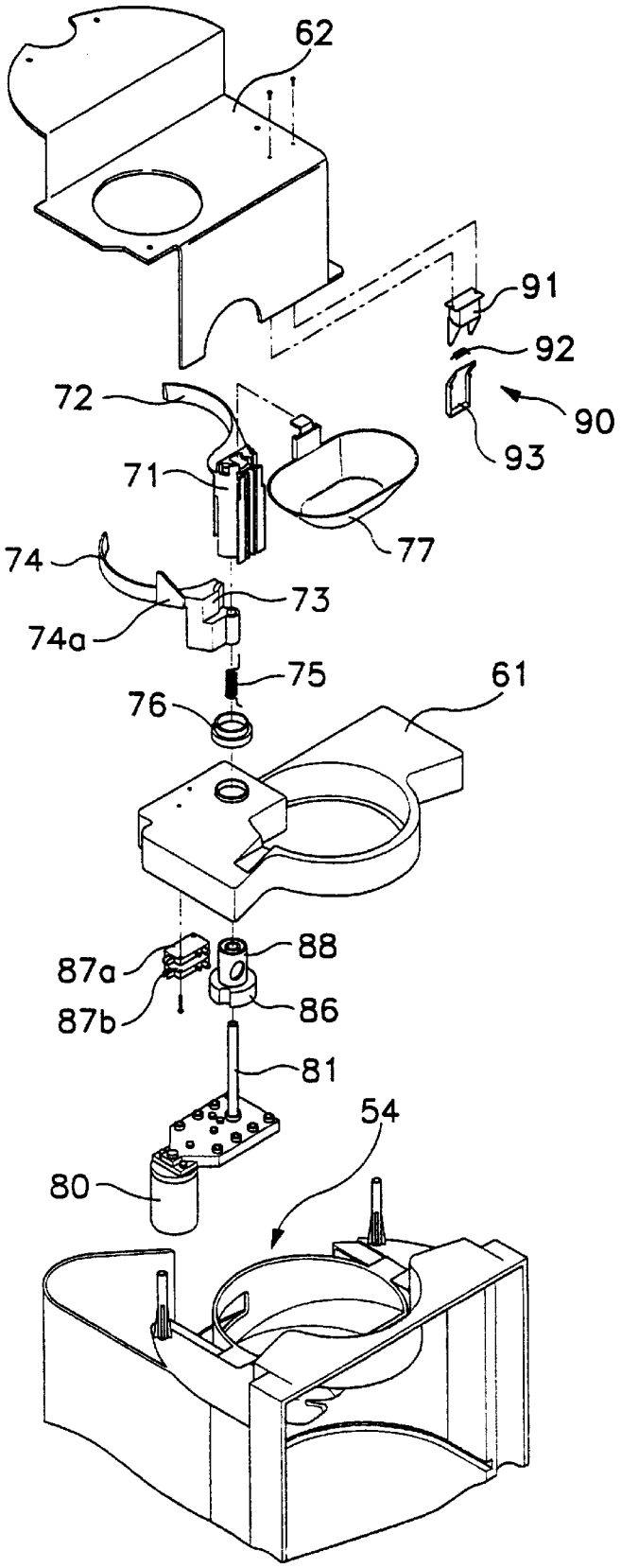
FIG. 3 is an exploded perspective view of a cup transfer device shown in FIG. 2.
Figure 4:
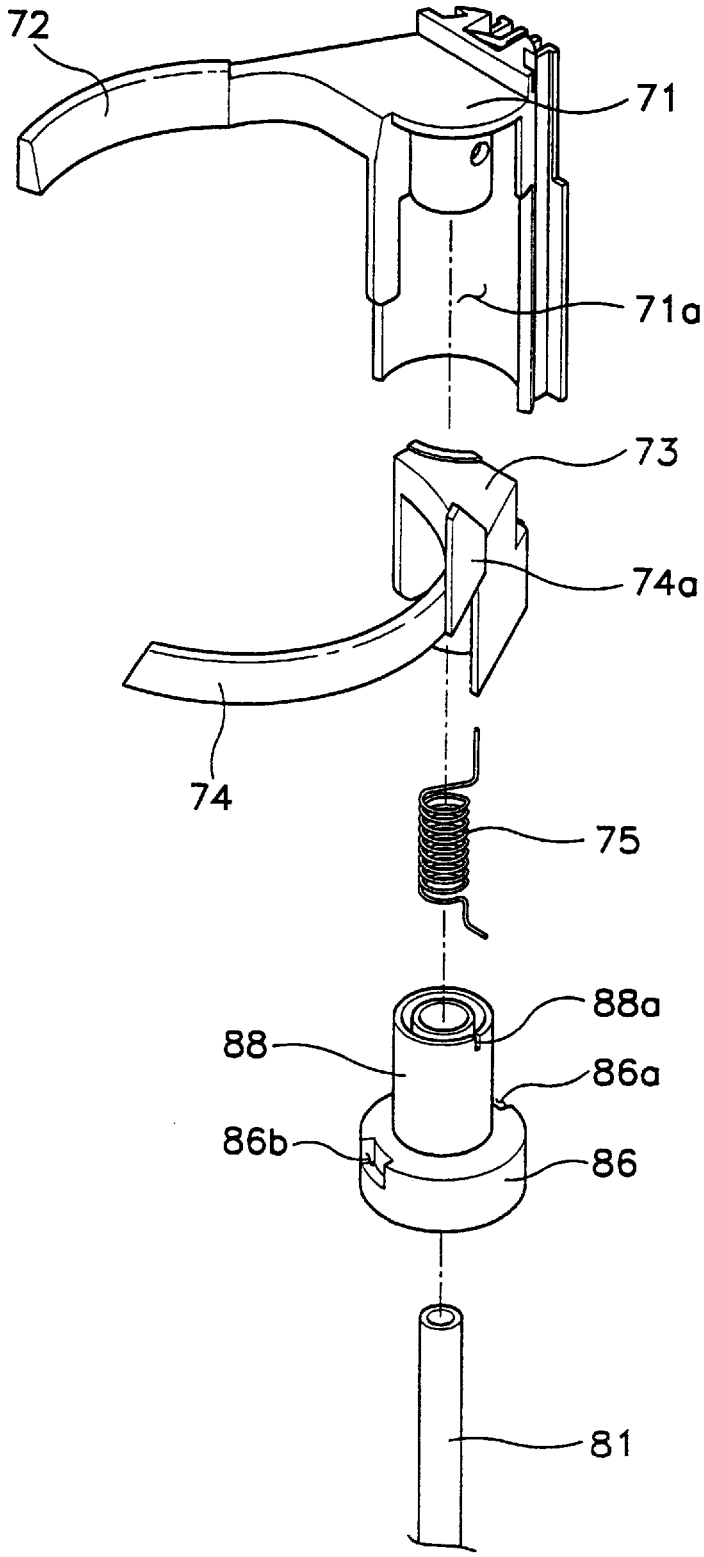
FIG. 4 is an exploded perspective view of main elements of the cup transfer device shown in FIG. 2.

Referring to FIGS. 3 and 4, shown respectively are an exploded perspective view of the cup transfer device 60 and an exploded perspective view of main elements of the cup transfer device 60.

The cup transfer device 60 includes cup supporting means for receiving and holding the cups 53*a* discharged from the cup dispenser 53, a motor 80 for rotating the cup supporting means, motor control means for controlling the drive operation of the motor 80, and cup dropping means for controlling the dropping of the cups 53*a* from the cup supporting means onto the cup tray 54.

In more detail, the cup supporting means is comprised of a fixing portion 71 connected to a shaft 81 of the motor 80, the fixing portion 71 having an opened portion 71*a* (see FIG. 4) formed on one side thereof; a first holder 72 integrally formed on an upper part of the fixing portion 71 and having a predetermined curvature; a rotating portion 73 positioned partly in the opened portion 71*a* of the fixing portion 71 and rotatably connected to the shaft 81 of the motor 80; and a second holder 74 integrally formed on an upper part of the rotating portion 73 and having a predetermined curvature, the second holder 74 opposing the first holder 72 to form a partial hoop with the same such that one of the cups 53*a* can be supported.

The first and second holders 72 and 74 are positioned together at predetermined locations by being rotated by the motor 80. That is, when the motor 80 is not operating, the first and second holders 72 and 74 are positioned under a cup discharge portion (not shown) of the cup dispenser 53. However, when the motor 80 operates, the first and second holders 72 and 74 are rotated to be positioned under the supply pipes 51*a* of the mixture containers 51, then above the cup tray 54, after which the holders 72 and 74 are further rotated to be positioned back under the cup dispenser 53. The will be described in more detail hereinafter.

The motor control means for controlling the rotation of the motor 80 includes a cam 86 connected to the shaft 81 of the motor 80 and rotating together with the same, and first and second microswitches 87*a* and 87*b* contacting an outer circumference of the cam 86 to control the operation of the motor 80. The first microswitch 87*a* is arranged above the second microswitch 87*b* and the integrally-formed microswitches 87*a* and 87*b* are connected to a bottom surface of a duct 61 by a fastener such as a screw, the duct 61 acting to guide one of the cups 53*a* to the cup tray 54.

Figure 5A:
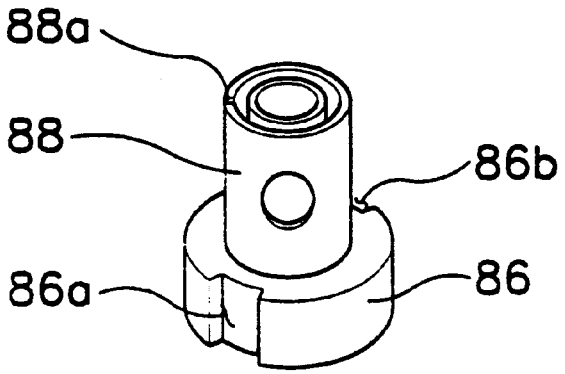
FIGS. 5*a* and 5*b* are perspective views of a cam of the cup transfer device shown in FIG. 2.
Figure 5B:
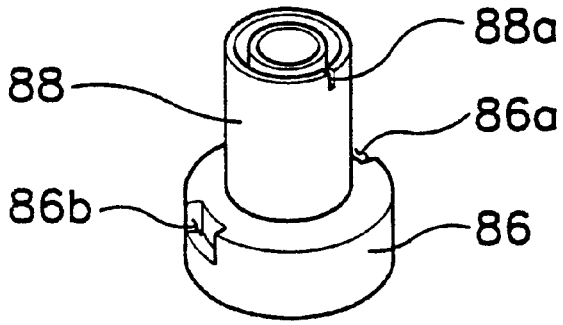

As shown in FIGS. 5*a* and 5*b,* the cam 86 is cylindrical and has formed first and second grooves 86*a* and 86*b* on an outer circumference thereof. The first groove 86*a,* as shown in FIG. 5*a,* is formed extending from a top of the cam 86 to a bottom of the same, while the second groove 86*b,* as shown in FIG. 5*b,* is formed starting from the top of the cam 86 but stopping at a middle portion thereof. The operational relationship between the first and second grooves 86*a* and 86*b* and the microswitches 87*a* and 87*b* will be described in more detail hereinafter.

A connecting portion 88 is integrally formed to a top of the cam 86 extending upwardly from the same, the connecting portion 88 passing through the duct 61. A spring 75 is interposed between the connecting portion 88 and the rotating portion 73 to provide elasticity to the second holder 74.

Referring to FIG. 4, one end of the spring 75 is inserted in an insertion hole (not shown) formed on an lower surface of the rotating portion 73, while the other end of the spring 75 is inserted in a slit 88*a* of the connecting portion 88, the slit 88*a* being formed longitudinally on an upper end and outer circumference of the connecting portion 88. Accordingly, the second holder 74 is given force in a direction toward the first holder 72 by the elasticity of the spring 75 such that a circular hoop is formed with these two elements, thereby enabling the holding of one of the cups 53*a* supplied from the cup dispenser 53.

With reference to FIG. 3, the cup dropping means includes a catch member 90 connected to a bracket 62, the bracket 62 provided between the cup dispenser 53 and the duct 61 to support the same; and an extension 74*a* formed on the second holder 74 and protruding upward from a rear portion of the same. The catch member 90 is comprised of a support 91 connected to one side of the bracket 62 through screws, and an elongating piece 93 rotatably connected to a bottom of the catch member 90 with an elastic member 92 interposed therebetween.

When the holders 72 and 74 are positioned over the cup tray 54 by being rotated thereto by the operation of the motor 80, the extension 74*a* contacts the elongating piece 93. That is, after one of the cups 53*a* has been filled with a powdered mixture, the holders 72 are rotated by the motor 80 to be located over the cup tray 54. Here, with the continued operation of the motor 80, although the first holder 72 proceeds in its rotation, the second holder 74 is prevented from further rotation by the extension 74*a* formed thereon contacting with the elongating piece 93 of the catch member 90. Accordingly, the rotating portion 73, to which the second holder 74 is integrally formed, pivots in the open portion 71*a* of the fixing portion 71 in a direction opposite that of the rotation of the first holder 72 such that the second holder 74 is spread apart from the same.

As a result of the above, the cup 53*a* drops onto the cup tray 54. Also, as the rotating portion 73 can no longer pivot in the open portion 71*a* of the fixing portion 71, the extension 74*a* of the second holder 74 exerts increasing force against the elongating piece 93 of the catch member 90 such that the elongating piece 93 is pushed upward against the tension of elastic member 92, thereby allowing the extension 74*a* of the second holder 74 to pass over the catch member 90. The second holder 74, therefore, returns to its initial position having a predetermined distance from the first holder 72. To enable this operation, it is preferable that the elastic force of the elastic member 92 of the catch member 90 is greater than that of the spring 75.

A powdered mixture collector 77, as shown in FIG. 3, is further provided as part of the cup transfer device 60. The powdered mixture collector 77 is mounted on a back of the fixing portion 71 and acts to collect the powdered mixtures not fully extracted from the supply pipes 51*a* of the mixture containers 51 during the supply of the powdered mixtures to the cups 53*a*. To facilitate this operation, the powdered mixture collector 77 is positioned under the supply pipes 51*a* when the vending machine is not in operation preparing beverages.

Further, a sealing member 76 is provided to prevented the powdered mixtures from entering in a space between the cam 86 and the duct 61, which would hinder the operation of the cup transfer device 60.

Figure 6:
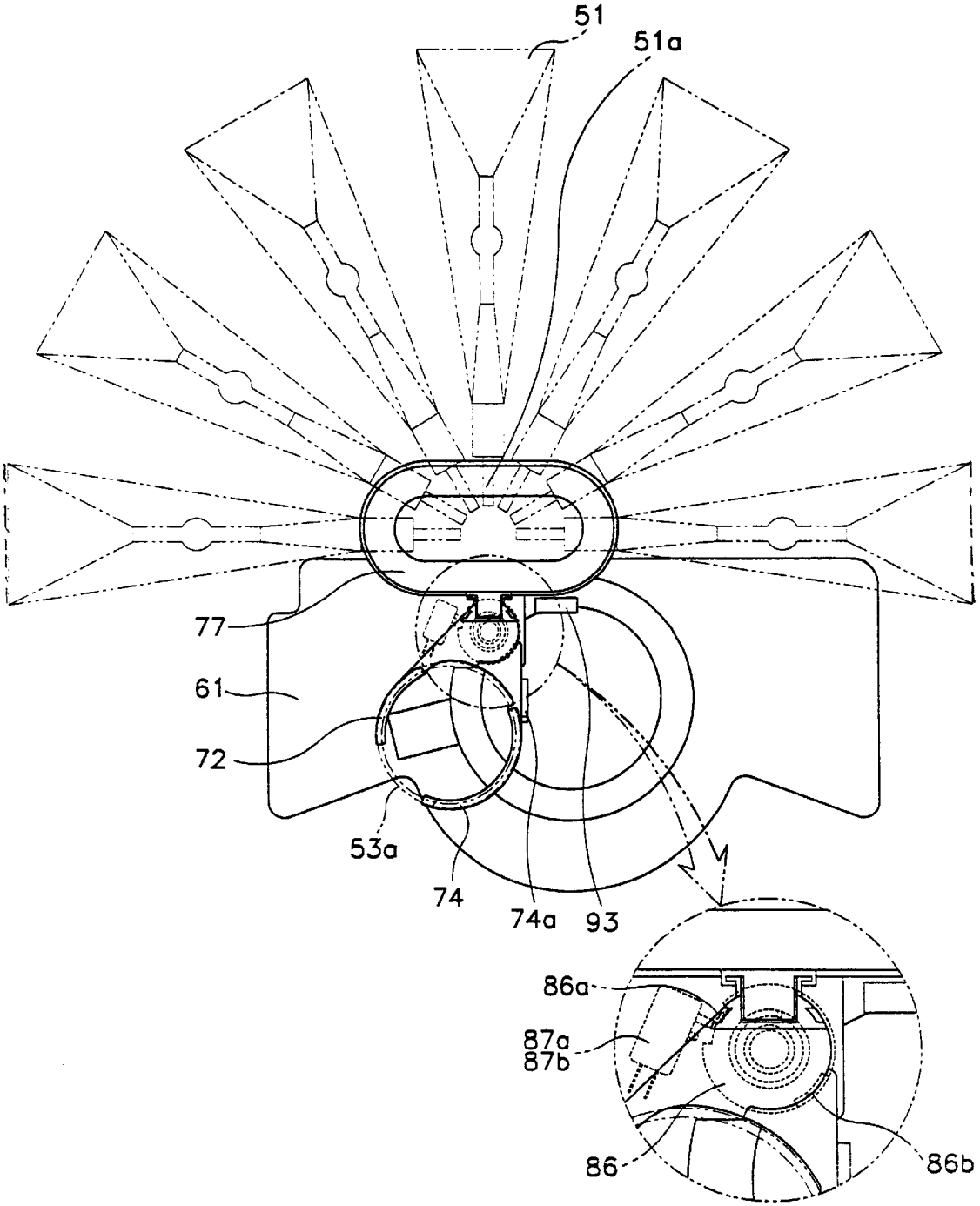
FIGS. 6, 7 and 8 are plan views of the cup transfer device shown in FIG. 2 in different operating positions.
Figure 7:
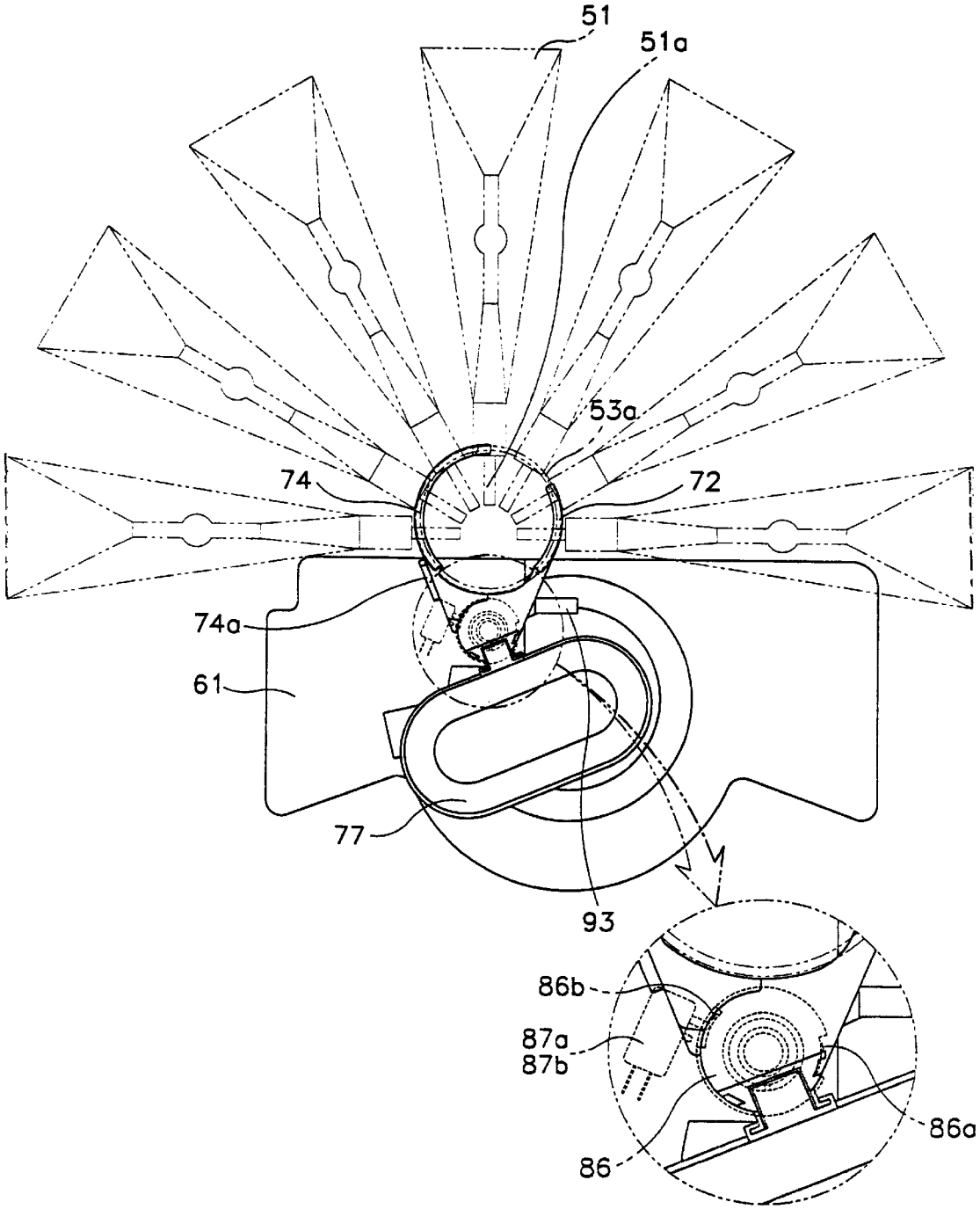
Figure 8:
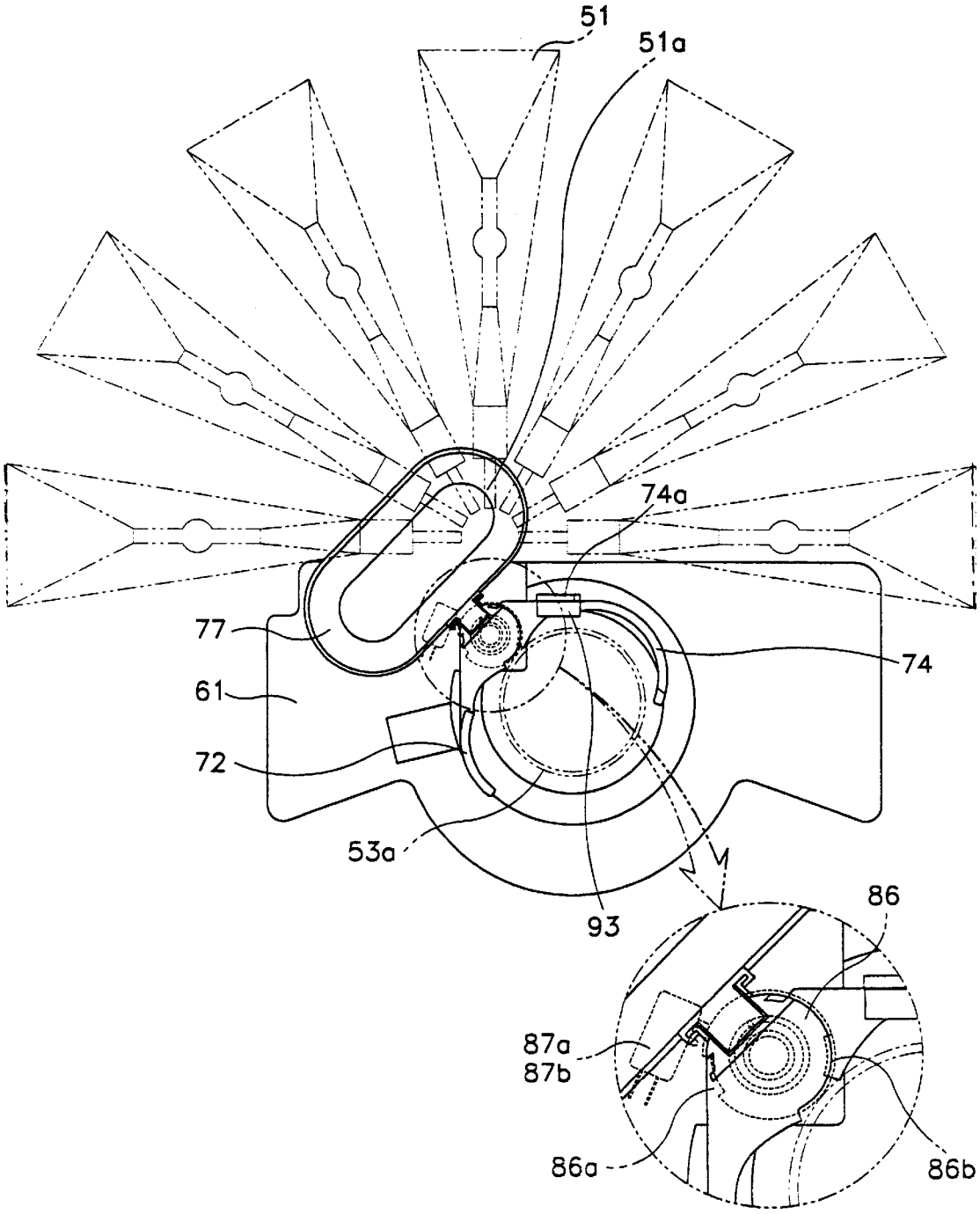

Referring now to FIGS. 6, 7 and 8, shown are plan views of the cup transfer device shown 60 in different operating positions.

First, in FIG. 6, illustrating a state in which the inventive vending machine is not in operation, the holders 72 and 74 are positioned under the cup discharge portion of the cup dispenser 53, and the powdered mixture collector 77 is located under the supply pipes 51*a* of the mixture containers 51. In this non-operating state of the vending machine, the first and second microswitches 87*a* and 87*b* are positioned at the first groove 86*a* of the cam 86 such that both the microswitches 87*a* and 87*b* are in an OFF state.

However, if a microcomputer operating signal is input by a customer inserting the required money in the vending machine and making a selection, one cup 53*a* is discharged from the cup dispenser 53 such that the cup 53*a* is held between the first and second holders 72 and 74. Next, the holders 72 and 74 begin to rotate by the operation of the motor 80. Simultaneously, the cam 86 also rotates so that the microswitches 87*a* and 87*b* make contact with the outer circumference of the same such that the microswitches 87*a* and 87*b* are changed to an ON state.

As shown in FIG. 7, the holders 72 and 74, onto which the cup 53*a* is placed, are rotated to be positioned under the supply pipes 51*a* of the mixture containers 51. As a result, the first microswitch 87*a* is positioned at the second groove 86*b* of the cam 86 so that the first microswitch 87*a* is changed to an OFF state, while the second microswitch 87*b* is maintained in an ON state as the same remains contacting the outer circumference of the cam 86.

When the above OFF and ON signals of the first and second microswitches 87*a* and 87*b,* respectively, are input to the microcomputer of the vending machine, the microcomputer conducts control such that the motor 80 remains stopped for a predetermined amount of time such that a predetermined amount of the selected powdered mixture is filled in the cup 53*a*. After this predetermined amount of time has elapsed, the microcomputer performs control to again drive the motor 80 such that the holders 72 and 74 continue their rotation. Accordingly, both the first and second microswitches 87*a* and 87*b* come to contact the outer circumference of the cam 86 such that the microswitches 87*a* and 87*b* change back to ON states.

As shown in FIG. 8, with the continued rotation of the holders 72 and 74, the same are positioned over the cup tray 54. As a result, the first holder 72 proceeds in its rotation, while the second holder 74 is prevented from further rotation by the the extension 74*a* formed thereon contacting with the elongating piece 93 of the catch member 90. Accordingly, the rotating portion 73, to which the second holder 74 is integrally formed, pivots in the open portion 71*a* of the fixing portion 71 in a direction opposite that of the rotation of the first holder 72 such that the second holder 74 is spread apart from the same such that the cup 53*a* drops onto the cup tray 54.

Next, as the rotating portion 73 can no longer pivot in the open portion 71*a* of the fixing portion 71, the extension 74*a* of the second holder 74 exerts increasing force against the elongating piece 93 of the catch member 90 such that the elongating piece 93 is pushed upward against the tension of elastic member 92, thereby allowing the extension 74*a* of the second holder 74 to pass over the catch member 90. The second holder 74, therefore, returns to its initial position having a predetermined distance from the first holder 72.

Next, the first and second microswitches 87*a* and 87*b* are again positioned at the first groove 86*a* of the cam 86 such that the microswitches 87*a* and 87*b* return to OFF states. As a result, the motor 80 is stopped and the holders 72 and 74 are positioned under the cup discharge portion of the cup dispenser 53.

In the above, after the cup 53*a* has been dropped on the cup tray 54, a predetermined amount of hot water from the hot water tank 52*a* is filled therein by nozzle 52*b* (see FIG. 2). After this operation, a stirrer is placed in the cup 53*a* using a separate device so that the customer can thoroughly mix the powdered mixture and the hot water.

In the vending machine of the present invention structured and operating as in the above, as powdered mixtures and water are directly dispensed into a cup, beverages are provided in a clean and sanitary manner, and the structure of the vending machine is simplified. Further, with the use of the powdered mixture collector, the inside of the vending machine is kept clean, thereby providing additional sanitary benefits.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A vending machine comprising a body defining an exterior of the vending machine, a plurality of mixture containers holding various powdered mixtures, a cup dispenser containing a plurality of cups and which dispenses the same, and a cup tray for receiving cups and from which the customer withdraws the same after the beverage has been made, being characterized in that a cup transfer device is provided between the cup dispenser and the cup tray, the cup transfer device receiving a cup from the cup dispenser, moving the cup under supply pipes of the mixture containers, and after the cup has received a predetermined amount of powdered mixture from the same, dropping the cup on the cup tray, wherein the cup transfer device includes cup supporting means for receiving and holding the cups discharged from the cup dispenser, a motor for rotating the cup supporting means, motor control means for controlling the drive operation of the motor, and cup dropping means for controlling the dropping of the cups from the cup supporting means onto the cup tray.

2. The vending machine of claim 1, wherein the cup supporting means comprises a fixing portion connected to a shaft of the motor, the fixing portion having an opened portion formed on one side thereof; a first holder integrally formed on an upper part of the fixing portion and having a predetermined curvature; a rotating portion positioned partly in the opened portion of the fixing portion and rotatably connected to the shaft of the motor; and a second holder integrally formed on an upper part of the rotating portion and having a predetermined curvature, the second holder opposing the first holder to form a partial hoop with the same such that one of the cups can be supported.

3. The vending machine of claim 2, the first and second holders follow a rotational path of being positioned under a cup discharge portion of the cup dispenser in a stand-by state, when the motor is not operating; being positioned under the supply pipes of the mixture containers; being positioned above the cup tray, then back under the cup dispenser.

4. The vending machine of claim 3, wherein the supply pipes of the mixture containers are directed to a single area to form a semi-circle, and a cover is mounted to one side of the supply pipes to prevent the scattering of the powdered mixtures during the supply of the same into the interior of the vending machine.

5. The vending machine of claim 1, wherein the motor control means comprises a cam connected to the shaft of the motor and rotating together with the same, and first and second microswitches contacting an outer circumference of the cam.

6. The vending machine of claim 5, wherein the cam is cylindrical and has formed first and second grooves on an outer circumference thereof, the first groove being formed extending from a top of the cam to a bottom of the same, while the second groove being formed starting from the top of the cam but stopping at a middle portion thereof.

7. The vending machine of claim 6, wherein when the first and second holders are positioned under the cup discharge portion of the cup dispenser in the stand-by state of the vending machine, the first and second microswitches are positioned at the first groove to be in an OFF state; and when the first and second holders are positioned under the supply pipes of the mixture containers by the operation of the motor, the first microswitch is positioned at the second groove to be in an OFF state, while the second microswitch is positioned contacting the outer circumference of the cam to be in an ON state such the motor is stopped from a predetermined amount of time to enable a predetermined amount of a powdered mixture from one of the mixture containers to be dispensed in a cup.

8. The vending machine of claim 6, wherein a connecting portion is integrally formed to a top of the cam extending upwardly from the same, the connecting portion passing through the duct; and a spring is interposed between the connecting portion and the rotating portion to provide elasticity to the second holder.

9. The vending machine of claim 1, wherein the cup dropping means comprises a catch member connected to a bracket, the bracket provided between the cup dispenser 53 and the duct to support the same; and an extension formed on the second holder and protruding upward from a rear portion of the same.

10. The vending machine of claim 9, wherein the catch member comprises a support connected to one side of the bracket, and an elongating piece rotatably connected to a bottom of the catch member with an elastic member interposed therebetween.

11. The vending machine of claim 10, wherein the elastic force of the elastic member of the catch member is greater than that of the spring supporting the second holder.

12. The vending machine of claim 11, wherein when the first and second holders are positioned over the cup tray, the second holder is prevented from further rotation by the extension formed thereon contacting with the elongating piece of the catch member such that the second holder is distanced from the first holder to enable the cup to drop onto the cup tray, after which the extension of the second holder passes over the catch member so that the second holder returns to its initial position having a predetermined distance from the first holder.

13. The vending machine of claim 1, wherein a powdered mixture collector is further provided as part of the cup transfer device, the powdered mixture collector gathering the powdered mixtures not fully extracted from the supply pipes of the mixture containers during the supply of the powdered mixtures to the cups.

14. The vending machine of claim 13, wherein the powdered mixture collector is removably mounted on a back of the fixing portion.

15. The vending machine of claim 14, wherein the powdered mixture collector is positioned under the supply pipes of the mixture containers when the vending machine is in a stand-by state.

* * * * *